US006789277B2

(12) United States Patent
Spitzer

(10) Patent No.: US 6,789,277 B2
(45) Date of Patent: Sep. 14, 2004

(54) NO DRIP BEDPAN

(76) Inventor: A. Robert Spitzer, 20180 W. Twelve Mile Rd., Suite 10, Southfield, MI (US) 48076

( * ) Notice: Subject to any disclaimer, the term of this patent is extended or adjusted under 35 U.S.C. 154(b) by 0 days.

(21) Appl. No.: 09/872,337

(22) Filed: Jun. 1, 2001

(65) Prior Publication Data

US 2002/0004949 A1 Jan. 17, 2002

Related U.S. Application Data

(60) Provisional application No. 60/209,021, filed on Jun. 2, 2000.

(51) Int. Cl.[7] ..... A61G 9/00
(52) U.S. Cl. ..... 4/451; 4/450
(58) Field of Search ..... 4/453, 452, 451, 4/450, 455, 484, 144.2, 144.3, 144.1

(56) References Cited

U.S. PATENT DOCUMENTS

| | | | | | |
|---|---|---|---|---|---|
| 2,315,390 | A | * | 3/1943 | Billeb | 4/484 |
| 3,475,767 | A | * | 11/1969 | Friesen et al. | 4/452 |
| 3,613,123 | A | * | 10/1971 | Lanstrom | 4/144.3 |
| 4,011,606 | A | * | 3/1977 | Scrafield et al. | 4/112 |
| 4,048,682 | A | | 9/1977 | Smith | |
| 4,117,845 | A | | 10/1978 | Brown | |
| 4,197,849 | A | * | 4/1980 | Bostick | 128/295 |
| 4,759,086 | A | * | 7/1988 | Booth-Cox | 4/451 |
| 4,974,270 | A | | 12/1990 | Kuhn | |
| 4,996,727 | A | * | 3/1991 | Wyatt | 4/484 |
| 5,329,644 | A | * | 7/1994 | Scott | 4/144.2 |
| 5,342,332 | A | * | 8/1994 | Wheeler | 604/349 |
| 5,455,972 | A | | 10/1995 | Williams | |
| 5,903,932 | A | * | 5/1999 | Whitesel | 4/476 |
| 6,070,277 | A | * | 6/2000 | Thomas | 4/484 |
| 6,189,162 | B1 | * | 2/2001 | Tanner | 4/450 |
| 6,199,220 | B1 | * | 3/2001 | Smith | 4/144.2 |

FOREIGN PATENT DOCUMENTS

| | | | | |
|---|---|---|---|---|
| GB | 2196246 A | * | 4/1988 | 4/452 |
| GB | 224522 A | * | 5/1990 | 4/452 |
| GB | 2229699 A | * | 10/1990 | 4/452 |

* cited by examiner

*Primary Examiner*—Gregory L. Huson
*Assistant Examiner*—Huyen Le
(74) *Attorney, Agent, or Firm*—Kohn & Associates, PLLC; Kenneth I. Kohn; Andrew M. Parial

(57) ABSTRACT

According to the present invention, there is provided an apparatus for collecting, disposing, and measuring liquids including a vessel with an inner surface and an absorption mechanism disposed on the inner surface of the vessel for absorbing and collecting liquids within the vessel. The present invention additionally provides for an absorption mechanism disposed on an inner surface of a vessel for preventing the spillage of any liquids, particularly those associated with excretory waste. Finally, the present invention provides for a method of using the apparatus claimed herein to collect, dispose, and measure liquid output from a bedridden individual.

12 Claims, 1 Drawing Sheet

NO DRIP BEDPAN

CROSSREFERENCE TO RELATED APPLICATIONS

This application claims the benefit of priority under 35 U.S.C. Section 119(e) of U.S. Provisional Patent Application No. 60/209,021, filed Jun. 2, 2000, which is incorporated herein by reference.

BACKGROUND OF THE INVENTION

1. Field of the Invention

This invention generally relates to the field of medical supplies and specifically towards the collection, disposal, and measurement of excretory waste from bedridden individuals.

2. Description of Related Art

Bed pans for capturing the release of excretory waste from bedridden individuals are known in the art. For example, U.S. Pat. No. 4,048,682 to Smith discloses an improved bedpan having a slidable cover for confining noxious odors. Bedpans have various sizes and shapes depending upon their use. Additionally, bedpans are composed of materials including both metal and plastics and are either reusable or disposable. Although most bedpans are used for the collection of both urine and feces, some are designed solely for urine capture. For instance, U.S. Pat. No. 4,117,845 to Brown discloses a conventional cylindrically shaped bed urinal having an outlet for drainage.

A problem with the use of most bedpans is spillage of the waste collected. Due to design and structural faults, excretory waste, especially urine, easily spills out of conventional bedpans. Spillage occurs at any time, but more often during transportion of the bedpan to a disposal repository. A major concern with spillage of excretory waste is the contamination of the areas where the spillage occurs. Moreover, those who handle the bedpans easily come into contact with the potentially harmful excretory waste. Since urine and feces contain harmful germs, bacteria and viruses, there is a concern of disease transmission to health care providers who handle bedpans.

Another problem occurring with the collection of excretory waste through the use of conventional bedpans is that it is often difficult to obtain accurate measurements of urine output from the patient, especially when both urine and feces are collected. As a result, inaccurate determinations of urine output hinder proper patient care.

Accordingly, there is a need for a bedpan that minimizes the spillage of excretory waste and thus reduces the risk of hazardous contamination from contact with the excretory waste thereof. Additionally, there is a need for an absorption mechanism that can be disposed on a disposable or reusable bedpan to minimize spillage. Moreover, there is a need for a bedpan that accurately measures the urine output of a patient.

SUMMARY OF THE INVENTION

According to the present invention, there is provided an apparatus for collecting, disposing, and measuring liquids including a vessel with an inner surface and an absorption mechanism disposed on the inner surface of the vessel for absorbing and collecting liquids within the vessel. The present invention additionally provides for an absorption mechanism disposed on an inner surface of a vessel for preventing the spillage of any liquids, particularly those associated with excretory waste. Finally, the present invention provides for a method of using the apparatus claimed herein to collect, dispose, and measure liquid output from a bedridden individual.

DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
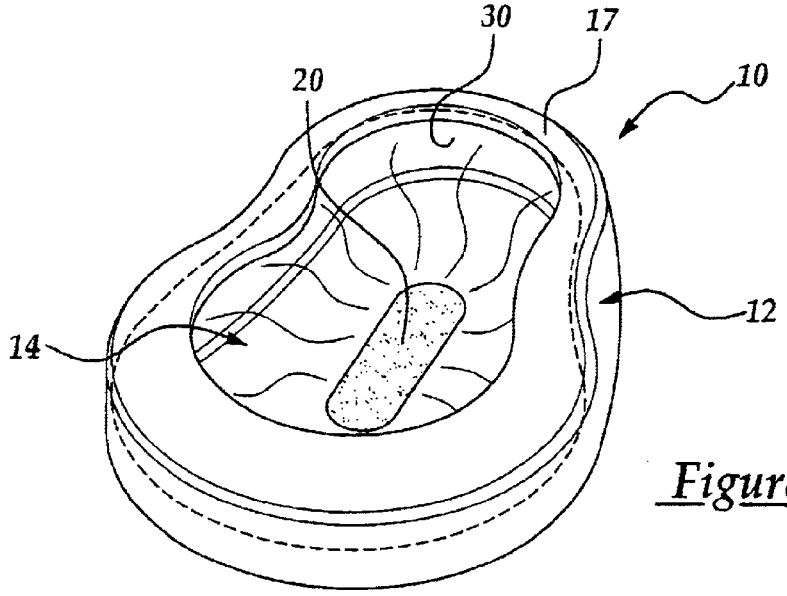
FIG. 1 is a perspective view of an embodiment of the present invention made of a vessel and an absorption mechanism.
Figure 2:
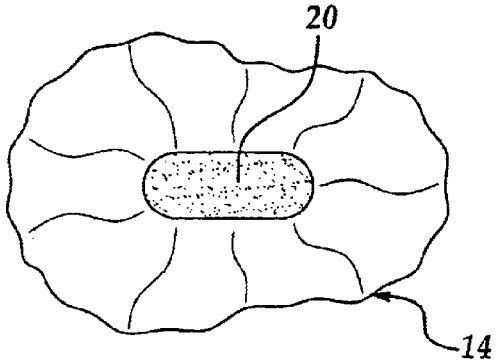
FIG. 2 is a top view of the absorption mechanism of an embodiment of the present invention with an optionally added super-absorbing material placed in the center of the absorption mechanism.
Figure 3:
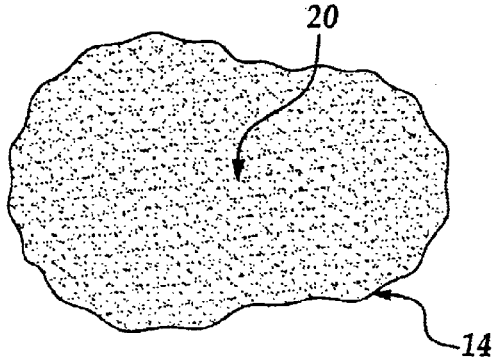
FIG. 3 is a top view of another embodiment of the present invention including the absorption mechanism having the super-absorbing material impregnated throughout the absorption mechanism.
Figure 4:
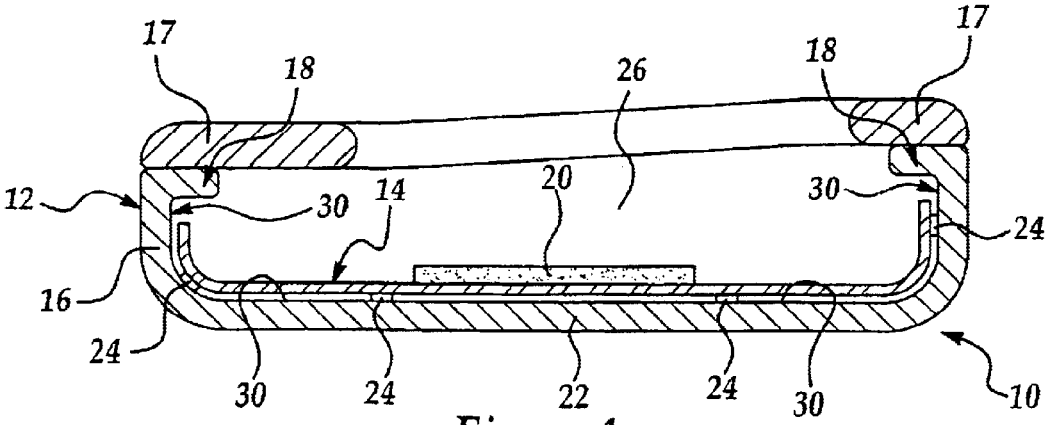
FIG. 4 is a cross-sectional elevation view of an embodiment of the present invention having the vessel and the absorptive mechanism disposed thereon, the figure additionally demonstrates the optional placement of a super-absorbing material centered onto the bottom of the vessel.

The present invention provides an apparatus, generally shown at 10 in the Figures, for improved collection and sanitary disposal of excretory waste from a bedridden individual. Preferably, the apparatus is a bedpan 10 including a vessel, generally indicated at 12 and an absorption mechanism generally indicated at 14. The vessel includes side walls 16, inner lips 18 for preventing liquid spill over, a bottom wall 22, and optionally, a seating surface 17. The absorption mechanism 14 is disposed on the bottom wall 22 of the vessel 12 and is secured thereto through attachment mechanisms 24. The absorption mechanism 14 optionally includes a super-absorbing material 20 either concentrated in the center of the absorption mechanism 14 as illustrated in FIG. 2 or dispersed and impregnated throughout the absorption mechanism 14 as illustrated in FIG. 3. The apparatus 10 is either disposable or reusable and varies in sizes and shapes.

The terms "bedpan" 10 and "apparatus" 10 as used herein are meant to include, but are not limited to, a vessel used by a bedridden person for collection of excretory waste such as urine and feces. Bedpans are generally known in the art and vary in size, shape, and volume capacity. Preferably, the present invention is an oval-shaped receptacle with a seating surface 17.

The term "vessel" 12 as used herein is meant to include, but is not limited to, a concave structure designed to hold and retain liquids. Generally, the vessel has side walls 16, inner lips 18, and a bottom wall 22 that are all impervious to liquids. The vessel 12 has a large opening 26 for receiving excrement and optionally, a seating surface 17 surrounding the opening 26. Optionally, the vessel 12 forms an inner chamber 25 for placement of the absorption mechanism 14 therein. The vessel 12 is made from materials including, but not limited to, plastic, polyurethane, metal, glass, polymers, and other similar liquid impervious materials known to those of skill in the art.

The term "absorption mechanism" 14 or "absorbent layer material" 14 as used herein is a layer of material that is absorbent to various liquids. Specifically, the absorption mechanism 14 is made of materials including, but not limited to, artificial and natural fibers, paper materials, sponge, cloth, cotton, and any other similar liquid absorbing materials known to those of skill in the art. The absorption mechanism 14 optionally has a super-absorbing material 20 that has increased liquid absorbency.

The term "super-absorbing material" 20 as used herein is meant to include, but is not limited to, a gel, silica, resins such as hydrolyzed starch-acrylonitrile graft polymers or neutralized starch-acrylic acid graft polymer, absorbent powders, desiccating agents, chemical compounds such as polyacylamide, polyacrylate, or potassium, crystals, and other similar liquid absorbing substances or materials known to those of skill in the art. The super-absorbing material 20 is concentrated within the center of the absorption mechanism 14 (FIG. 2), or the absorption mechanism 14 is impregnated with the super-absorbing material 20 (FIG. 3).

The term "deodorizer" as used herein is meant to include, but is not limited to, any odor reducing substance known to those of skill in the art. The deodorizer is either placed on or within the absorption mechanism 14, super-absorbing material 20, or both.

The term "disinfectant material" as used herein is meant to include, but is not limited to, any antiseptic, germicide, anti-viral, antibacterial substance and any similar substance known to those of skill in the art. The disinfectant material is either placed on or within the absorption mechanism 14, super-absorbing material 20, or both.

The term "attachment mechanism" 24 as used herein is meant to include, but is not limited to, Velcro, snaps, buttons, string, glue, tape, adhesives, elastic, fasteners, and any other affixing devices known to those of skill in the art. The attachment mechanism 24 is used to attach the absorbent layer material 14 to an interior or exterior portion of the vessel. The attachment mechanism 24 can be placed on any location of the absorption mechanism 14.

The term "excrement" as used herein is meant to include, but is not limited to, urine, solid feces, liquid feces, water, stool, body fluids, vomit, and any substance cast out as waste from the body.

The present invention is applicable for use in any setting including, but not limited to, hospitals, assisted living homes, medical offices, patient homes, emergency rooms, public and private facilities, and any other similar settings where the device is needed by an individual.

There are several embodiments of the present invention. All of the embodiments are well suited for use in the collection of human excrement, especially urine, from individuals. In one embodiment, the present invention is a vessel 12 including a large opening 26 for receiving excretory waste, side walls 16, inner lips 18 for retaining spill over of liquids, and a bottom wall 22. Another embodiment of the present invention is the absorption mechanism 14 itself, whereby the absorption mechanism 14 is placed within a disposable or reusable bedpan 10. If the present invention is placed within a disposable bedpan 10, then the bedpan 10 and the absorption mechanism 14 can be entirely disposed of in the appropriate repository. However, if the present invention is placed within a reusable bedpan, then the absorption mechanism 14 can be solely removed from the reusable bedpan 10 and be disposed of thereafter in the appropriate repository.

The absorption mechanism 14 collects and retains liquids including urine, water, liquid fecal matter, and other similar body fluids. The absorption mechanism is either laid in the bottom inner surface 28, connected to the inner surface 28 of the bottom wall 22 through attachment mechanisms 24, connected to the inner surface 30 of the side walls 16 through attachment mechanisms 24, or connected to both the inner surface 30 of the side walls 16 and the inner surface 30 of the bottom wall 22 through attachment mechanisms 24. The absorption mechanism 14 can be placed in a disposable bedpan 10 or be placed in a reusable bedpan 10. Additionally, the absorption mechanism 14 can be retrofitted onto any currently existing bedpans 10 and can either be permanently or removably attached to the bedpan 10. The absorption mechanism 14 optionally includes super-absorbing material 20 concentrated in the center of the absorption mechanism 14 as generally shown in FIG. 2. Alternatively, super-absorbing material 20 is dispersed or coated throughout the absorption mechanism 14 as generally shown in FIG. 3. A deodorizer is impregnated into absorption mechanism 14, super-absorbing material 20, or both. Additionally, a disinfectant is placed onto the absorption mechanism 14, super-absorbing material 20, or both.

In another embodiment of the present invention, there is provided a single, disposable unit comprising an external standard bedpan-shaped vessel 12 including the absorption mechanism 14 and super-absorptive material 20. In the preferred embodiment, the absorption mechanism 14 is attached to both the inner surface 30 of the vessel 12 through attaching mechanisms 24.

The present invention is capable of separating liquid waste, such as urine, from solid waste, such as feces. Thus, the present invention is well suited for weighing and measuring liquid waste weight and volume. Easy and safe measurement of patients' urine output is computed by first determining the weight of an unused bedpan 10 including the absorption mechanism 14. Then, after collecting both solid and liquid waste, the solid waste is scraped out and removed from the bedpan 10. Next, the used bedpan 10 is subsequently weighed to determine liquid output.

Alternatively, urine output is computed by just weighing the absorption mechanism 14. First, the unused absorption mechanism 14 is weighed. Then, the absorption mechanism 14 is placed and secured to the vessel 12 of the bedpan 10. After the bedpan 10 is used, the solid waste is scraped out and removed from the bedpan 10. Next, the absorption mechanism 14 is detached from the vessel 12 of the bedpan 10. Finally, the absorption mechanism 14 containing the absorbed liquids is weighed and the liquid output is determined. Subsequently, the bedpan 10 is reused for additional collection of excrement from patients.

Another embodiment of the present invention provides using the absorption mechanism 14 as an integrated part with a conventional bedpan. The absorption mechanism 14 is easily adaptable for placement onto or over a conventional bedpan 10. Various attaching mechanisms 24 known to those of skill in the art are utilized to secure the absorption mechanism 14 to the bedpan. FIG. 2 and FIG. 3 show an insertable unit including the absorption mechanism 14 and super-absorbing material 20 for placement and attachment within a commonly used bedpan 10.

In operation, the present invention includes the steps of positioning the bedpan 10 including the vessel 12 having the inner surface 30, and absorption mechanism 14 disposed on the inner surface 30 of the vessel 12. Then, solid and liquid waste are collected with the liquid waste being separated from the solid waste by absorption of the liquid waste in the absorption mechanism 14 and super-absorbing mechanism 20, or both. Finally, the bedpan is disposed of in the appropriate waste repository. Additionally, the operation of the present invention includes a further step of collecting liquid and solid waste, but only measuring the amount of captured liquids. Thus, a determination of the amount of liquids excreted by an individual is accurately determined.

Throughout this application, various publications, including United States patents, are referenced by author and year and patents by number. Full citations for the publications are listed below. The disclosures of these publications and patents in their entireties are hereby incorporated by reference into this application in order to more fully describe the state of the art to which this invention pertains.

The invention has been described in an illustrative manner, and it is to be understood that the terminology that has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

What is claimed is:

1. A single, disposable apparatus for collecting, disposing, and measuring liquids, comprising:

a bed pan vessel including side walls, a bottom wall, a seating surface, an inner surface, wherein said vessel is made of materials selected from the group consisting of elastic, polyurethane, metal, glass, and polymers; and absorption means fixedly attached to and disposed on all of said inner surface of said vessel for absorbing and collecting liquids within said vessel, wherein said vessel and said absorption means form a disposable single-unit apparatus and said side walls space a user from said absorption means and any contents within said vessel when the user fully sits upon said seating surface.

2. The apparatus according to claim 1, wherein said vessel is further defined as an oval-shaped receptacle.

3. The apparatus according to claim 1, wherein said absorption means is made of material that absorbs, collects, and retains liquids including urine, water, liquid fecal matter, and body fluids.

4. The apparatus according to claim 3, wherein said absorption means is made of material selected from the group consisting essentially of artificial and natural fibers, paper materials, and sponge materials.

5. The apparatus according to claim 4, wherein said absorption means further includes super-absorbing means centrally located on said inner surface of said vessel for absorbing, collecting, and retaining liquids including urine, water, liquid fecal material, body fluids, and vomit.

6. The apparatus according to claim 5, wherein said super-absorbing means is made of material selected from the group consisting essentially of gel, solid crystals, and powder.

7. The apparatus according to claim 6, wherein said attaching means is selected from the group consisting essentially of Velcro, snaps, buttons, string, tape, glue, adhesive, elastic, and fasteners.

8. The apparatus according to claim 1 including attaching means for attaching said layer to said vessel.

9. A method of using an apparatus for collecting liquids comprising the steps of:

positioning the apparatus including a vessel having side walls, a bottom wall, a seating surface, an inner surface, and absorption means disposed on the inner surface of the vessel for absorbing liquids within the vessel, wherein the vessel is made of materials selected from the group consisting essentially of plastic, polyurethane, metal, glass, and polymers and the side walls space a user from the absorption means and any contents within the vessel when the user fully sits upon said seating surface; and collecting liquid and solid waste while isolating liquid waste from the solid waste in the vessel.

10. The method according to claim 9, wherein said collecting step further includes collecting only liquid waste and disposing the solid waste thereof.

11. The method according to claim 9 including the further step of determining urine output.

12. A disposable, single-unit bed pan vessel including side walls, a bottom wall, a seating surface, and an inner chamber, wherein said vessel is made of materials selected from the group consisting of plastic, polyurethane, metal, glass, and polymers and said side walls space a user from any contents from within said vessel when the user fully sits upon said seating surface; and absorption means fixedly secured and disposed entirely within said inner chamber for absorbing liquids.

* * * * *